United States Patent [19]

Kobayashi et al.

[11] 4,116,030

[45] Sep. 26, 1978

[54] METHOD OF MAKING PROFILED WORK OF ALUMINUM OR ALUMINUM ALLOY BY EXTRUDING PROCESS

[75] Inventors: Yoshiyuki Kobayashi; Shigeru Okaniwa, both of Fuji, Japan

[73] Assignee: Kabushikikaisha Nippon Keikinzoku Sogokenkyusho, Tokyo, Japan

[21] Appl. No.: 789,734

[22] Filed: Apr. 21, 1977

[30] Foreign Application Priority Data

Apr. 23, 1976 [JP] Japan ..... 51-45323

[51] Int. Cl.[2] ..... B21C 23/32; B21C 35/06

[52] U.S. Cl. ..... 72/40; 72/253 R

[58] Field of Search ..... 72/42, 39, 40, 253, 72/271

[56] References Cited

U.S. PATENT DOCUMENTS

| | | | |
|---|---|---|---|
| 2,047,237 | 7/1936 | Updegraff | 72/38 |
| 2,135,193 | 11/1938 | Moorhead | 72/253 |
| 2,971,644 | 2/1961 | Sejournet | 72/39 |
| 3,919,870 | 11/1975 | Wassen | 72/39 |

FOREIGN PATENT DOCUMENTS

| | | | |
|---|---|---|---|
| 1,153,536 | 8/1963 | Fed. Rep. of Germany | 72/253 |
| 1,202,483 | 8/1970 | United Kingdom | 72/253 |

*Primary Examiner*—C.W. Lanham
*Assistant Examiner*—D. M. Gurley
*Attorney, Agent, or Firm*—Oblon, Fisher, Spivak, McClelland & Maier

[57] ABSTRACT

The method of making a profiled work of aluminum or aluminum alloy comprises the steps of loading a billet of aluminum or aluminum alloy in a container having an extruding die at its one end and urging the billet against the extruding die by a ram so as to extrude the billet through the die to form a profiled work of aluminum or aluminum alloy with its cross-section conforming with that of the die. A disc of aluminum or aluminum base alloy containing at least one or two elements selected from the group consisting of elements B, Be, Ti, Zr, W, Mo and V is located between the extruding die and the billet before the billet is extruded. The element contained in the disc forms very hard and fine abrasive particles and the abrasive particles are extruded together with the mass of the billet through the extruding die so that the material of the billet sticking to the bearing surface of the extruding die is removed from the bearing surface and the bearing surface is polished so as to prevent the material of the billet from further sticking to the bearing surface thereby permitting the extruding velocity to be raised without causing any surface defects such as flaws, die-lines, pick-up and scores, while the brilliance of the surface of the extruded profiled work is raised and no local decolorization in the surface occurs after anodic oxidation treatment of the profiled work.

16 Claims, 11 Drawing Figures

METHOD OF MAKING PROFILED WORK OF ALUMINUM OR ALUMINUM ALLOY BY EXTRUDING PROCESS

BACKGROUND OF THE INVENTION

The present invention relates to a method of making a profiled work of aluminum or aluminum alloy by extruding process.

Recently, profiled works of aluminum or aluminum alloy of various configurations in cross-section produced by extruding process have been increasingly made important in the construction works such as buildings, engineering works, vehicles and the like.

The most important problem in manufacturing profiled works of aluminum or aluminum alloy by extruding process lies in the improvement in the extruding velocity in mass production of the profiled works while superior quality of the surface of the profiled work is maintained.

However, when a billet of aluminum or aluminum alloy is extruded through an extruding machine so as to produce a profiled work, frictional heat generated between the bearing surface of the extruding die and the mass of the billet flowing along the bearing surface of the die increases as the extruding velocity is raised, so that the material of the billet tends to stick to the bearing surface of the die thereby deteriorating the surface condition of the bearing surface and resulting in surface defects formed in the surface of the extruded profiled work. Thus, the upper limit of the extruding velocity is necessarily set at a certain value and it is extremely difficult to raise the extruding velocity beyond the thus set upper limit without causing any surface defects of the profiled work.

In order to avoid the above described sticking of material of the billet to the bearing surface of the extruding die during the extruding process, it has been proposed to include a little quantity of element B in the billet.

By such a measure, however, the content of B to be included in the billet must be greater than 0.01% by weight and, preferably, greater than 0.03% in order to achieve satisfactory results. A billet of aluminum or aluminum alloy containing such a large amount of B tends to absorb excessive gas during the casting procedure of the billet so that it is not only difficult to obtain satisfactory profiled works having sound mechanical properties from such a gas including billet but also the profiled works produced from such a billet tends to cause local decolorizations of the surface of the profiled work on account of the presence of B component when it is subjected to anodic oxydation treatment so that local colorless spots are generated in the colored surface of the anodized film formed on the profiled work by the anodic oxidation treatment, thereby deteriorating the surface quality of the product and increasing the percent defective of the products.

The present invention aims at avoiding the above described disadvantages of the prior art method of making a profiled work of aluminum or aluminum alloy by extruding process.

SUMMARY OF THE INVENTION

The object of the present invention is to eliminate the above described disadvantages of the prior art method and to provide a novel and useful method of making a profiled work of aluminum or aluminum alloy by extruding process by which the production efficiency is extremely improved while a high quality of the product is insured.

The above object is achieved in accordance with the present invention by providing a method of making a profiled work of aluminum or aluminum alloy by extruding process including the steps of loading a billet of aluminum or aluminum alloy into a container mounting on its one end an extruding die having at least an extruding hole of required cross-section and moving a ram into the container from the opposite end thereof against the billet to urge the same toward the extruding die so as to permit the billet to be extruded through the extruding hole of the die thereby forming a profiled work having the cross-section conforming with the cross-section of the extruding hole, the method being characterized by locating an abrasive containing disc of aluminum or aluminum alloy between the extruding die and the billet prior to the extruding operation of the billet.

According to the characteristic feature of the present invention, the abrasive containing disc to be interposed between the extruding die and the billet is made of aluminum or aluminum base alloy preferably having the same composition as that of the billet with which the disc is extruded together, and the disc contains at least one or two elements selected from the group consisting of the elements B, Be, Ti, Zr, W, Mo and V as abrasive forming elements.

Such components included in the disc form very hard and fine particles of micron or sub-micron size and these particles act as an abrasive during the extruding operation so that the material of the billet sticking to the bearing surface of the extruding hole of the die during the extruding operation is removed therefrom by the abrasive and is polished so as to prevent the material of the billet from further sticking to the bearing surface of the die and permit the extruding velocity to be extremely raised without causing any surface defects in the extruded profiled work while superior brilliancy of the surface of the product is insured.

Since the billet per se does not contain the above described elements acting as the abrasive, no local decolorization occurs in the surface of the product when it is subjected to anodic oxidation treatment thereby positively preventing colorless spots from being formed on the film surface produced on the product by the anodic oxidation treatment for hardening and coloring purposes.

During the extruding operation, a very small portion of the abrasive particles contained in the disc is gradually and successively extruded out through the extruding hole of the die together with the mass of the billet and flows along the bearing surface of the die for effecting the above described polishing thereof, and such a small quantity of the abrasive particles will not affect on the surface of the product since the abrasive particles are adhered only on the surface of the product and easily removed by processing acidic or alkaline solution treatment of the product so that local decolorization of the surface is substantially avoided after the anodic oxydation treatment is effected and superior brilliancy of the surface of the product is insured.

DETAILED DESCRIPTION OF THE PREFERRED EMBODIMENTS

Figure 1:
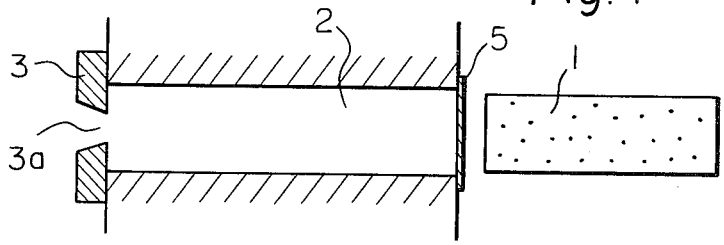
FIG. 1 is a schematic sectional view showing the method of the present invention in the state prior to the loading of the billet in the container.
Figure 2:
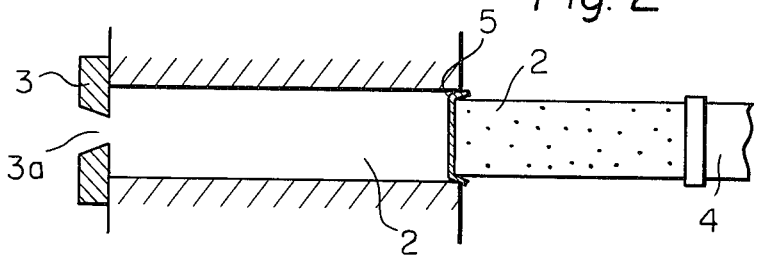
FIG. 2 is a schematic sectional view similar to FIG. 1 but showing the state when the abrasive containing disc begins to be pushed into the container together with the billet.
Figure 3:
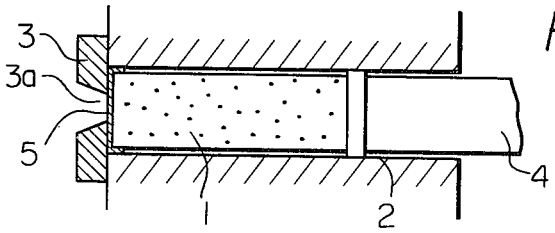
FIG. 3 is a schematic sectional view similar to FIG. 1 but showing the state in which the extruding operation is being commenced by the action of the ram so that the abrasive containing disc begins to be extruded through the extruding hole of the die together with the billet.

Referring to FIGS. 1–3, the extruding process comprises in the well known manner the steps of loading a billet 1 of aluminum or aluminum alloy into a container 2 having an extruding die 3 at its one end and moving a ram 4 into the container 2 so as to urge the billet 1 against the die 3 thereby permitting the billet 1 to be extruded through the extruding hole 3*a* of the die 3 to form a profiled work of aluminum or aluminum alloy with the cross-section thereof conforming with that of the extruding hole 3*a*.

In accordance with the characteristic feature of the present invention, an abrasive containing disc 5 is located between the billet 1 and the extruding die 3 prior to loading of the billet 1 into the container 2 so that the disc 5 is sandwiched between the front end of the billet 1 and the surface of the die 3 facing to the billet 1 prior to the commencement of the extruding operation.

Figure 11:
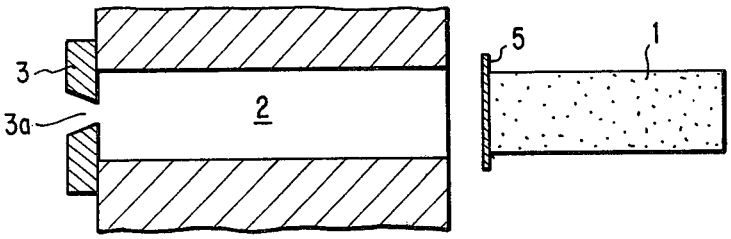
FIG. 11 is a view similar to FIG. 1, but showing the disc fastened to the front of the billet.

In order to properly locate the disc 5 in position between the die 3 and the billet 1, the disc 5 may be attached to the front end of the billet 1 as shown in FIG. 11 by means such as riveting and welding or the disc 5 may be fed to the open end of the container 2 in position to cover the open end by means of a feeding machine (not shown) so that the disc 5 is brought into the container 2 together with the billet 1 as the same is loaded in the container 2.

Figure 4:
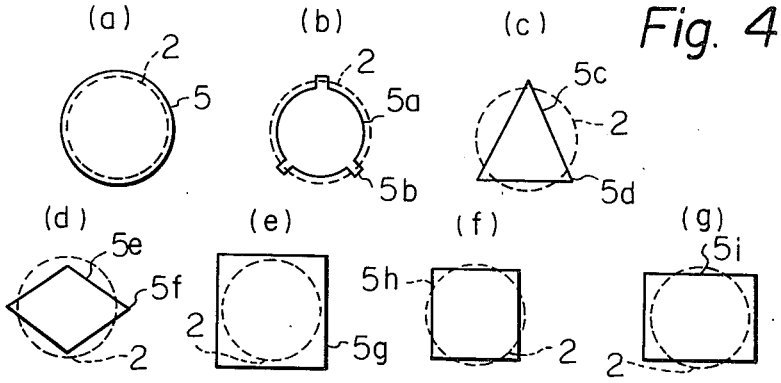
FIG. 4 shows various configurations of the abrasive containing disc indicated by solid lines with the inner diameter of the container being indicated by broken lines for the showing of the relationship therebetween.

In order to securely locate the disc 5 in position on the front end of the billet 1, the outer periphery of the disc 5 is so configured that the outer periphery extends at least partially beyond the inner diameter of the container 2 as shown in FIG. 4 so that portions of the disc 5 extending beyond the inner diameter of the container 2 are clamped between the inner peripheral surface of the container 2 and the outer peripheral surface of the billet 1 as the billet is moved into the container 2 so as to prevent relative movement of the disc 5 with respect to the front end of the billet 1. The disc 5 (FIG. 4(*a*)) is circular in shape having a diameter greater than the inner diameter of the container 2, the disc 5*a* (FIG. 4(*b*)) having a diameter smaller than the inner diameter of the container 2 but having a plurality of ears 5*b* extending beyond the inner diameter of the container 2, the disc 5*c* (FIG. 4(*c*)) trangular in shape with the apices 5*d* extending beyond the inner diameter of the container 2, the disc 5*e* (FIG. 4(*d*)) being tetragonal in shape with the apices 5*f* extending beyond the inner diameter of the container 2, the discs 5*g*, 5*h* and 5*i* shown in FIGS. 4(*e*), (*f*) and (*g*), respectively being rectangular in shape with all sides or all apices extending beyond the inner diameter of the container 2.

As described previously, the disc 5 contains at least one or more elements selected from the group consisting of B, Be, Ti, Zr, W, Mo and V as the abrasive forming elements so that the polishing effect on the bearing surface of the extruding hole 3*a* of the die 3 is obtained during the extruding operation wherein material of the billet 1 sticking to the bearing surface is positively removed while the bearing surface is polished thereby positively preventing material of the billet 1 from further sticking to the bearing surface so that the extruding velocity can be extremely raised, while superior surface quality of the product is insured and no local decolorization occurs after anodic oxidation treatment.

The thickness of the disc 5 is selected to be in the range of 0.1 and 10mm depending upon the condition of the extruding process so as to keep the material of the disc 5 until the end of the extruding operation, thereby insuring superior surface condition of the product over the entire length thereof.

However, excessively great thickness of the disc must be avoided in order to prevent the possibility of sticking the abrasive to the surface of the product resulting in deterioration of the surface quality.

Now, the effectiveness of each of the elements B, Be, Ti, Zr, W, Mo and V for achieving the polishing effect on the bearing surface of the extruding hole 3*a* of the die 3 and the improvement in the extruding velocity as well as the surface quality of the product will be described in detail.

Inclusion of B by 0.003% or more by weight in the disc 5 already permits the surface defects such as pick-up to be reduced during the extruding operation although the reflecting power of the surface of the extruded profiled work is not so much improved. Inclusion of B by 0.005% or more by weight results in extreme reduction in pick-up while the reflecting power is improved. Inclusion of B by 0.010% or more by weight permits the occurrence of pick-up to be completely avoided while the metallic brilliancy of the surface of the profiled work is much more improved. The extruding velocity is increased by about 80% or more by using a disc 5 containing 0.01% by weight of B than in the case no such disc is used. However, inclusion of B in excess of 0.500% by weight in the disc 5 tends to generate surface defects called "scores" in the surface of the product. Therefore, the content of B in the disc 5 is preferably selected to be in the range of 0.003 and 0.500% by weight depending upon the requirements and the condition of the extruding operation.

Inclusion of Be by 0.03% or more by weight in the disc 5 tends to reduce the pick-up although the substantial improvement in metallic brilliancy of the surface of the product is not obtained. Inclusion of Be by 0.05% or more by weight results in reduction of pick-up while the metallic brilliancy tends to be improved. The reduction of pick-up and the improvement in the brilliancy of the surface of the product are enhanced as the content of Be in the disc 5 increases up to 0.30% by weight, and the metallic brilliancy of the surface is raised by about 100% than the case no such disc is used. However, inclusion of Be in excess of 0.50% by weight results in rapid oxidation of molten metal from which the disc 5 is produced and the surface defects of the extruded profiled work tends to occur. At the same time, surface erosion of the product tends to occur when the profiled work is in practical use. The extruding velocity may be raised according to the reduction in pick-up.

Inclusion of Ti by 0.05% or more by weight results in reduction of pick-up, while the surface brilliancy of the product is improved. When Ti is used in addition to other element described above, Ti has a tendency to promote the reduction in size of the matrices of the base aluminum so that the hard and fine particles formed by the elements acting as the abrasive are dispersed more uniformly between the boundaries of the matrices of the base aluminum of the disc 5 thereby further improving the polishing effect on the bearing surface of the extruding hole 3*a* of the die 3. However, excessive content of Ti results in generation of metallic compounds in the disc 5 so that not only the surface of the product is damaged but also local defects are generated in the film which is produced on the product by anodic oxydation treatment. Therefore, the content of Ti is preferably selected to be in the range of 0.05 and 0.10% by weight. The extruding velocity can be raised according to the reduction in pick-up.

Inclusion of Zr by 0.03% or more by weight results in reduction of pick-up improvement in the surface brilliancy by 40% than the case no such disc containing Zr is used. Further inclusion of Zr, however, does not appreciably improve the effectiveness of the abrasive containing disc 5. Thus, the content of Zr in the disc 5 is preferably selected to be in the range of 0.03% and 1.00% by weight. The extruding velocity can be raised accordingly with the improvements in the surface quality of the product by using the disc 5.

In like manner, inclusion of W, Mo or V in the disc 5 results in reduction of pick-up. However, the surface brilliancy can not be so much improved by the inclusion of Mo or V except W. Inclusion of W can improve the surface brilliancy by about 40% than the case no such disc is used. The extruding velocity can be raised according to the reduction in pick-up. The content of the element W, Mo or V in the disc 5 is therefore selected to be in the range of 0.05 and 1.00% by weight in order to achieve required performance depending upon the condition of extruding operation.

When two or more elements selected from the group consisting of B, Be, Ti, Zr, W, Mo and V are included together in the disc 5, the surface brilliancy of the product is in general determined by the element having the strongest effect on the improvement thereof, however, when the total content of the elements included together in the disc 5 is excessively increased, surface defects in the product tends to increase. Therefore, inclusion of at least two elements together in the disc 5 suffices in order to achieve the required results.

Figure 5:
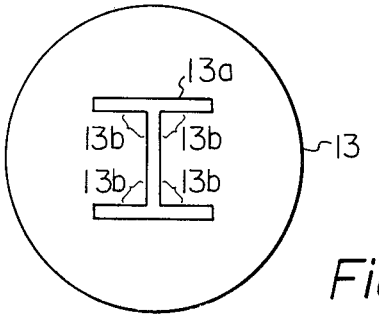
FIG. 5 is a front view showing an example of the configuration of the extruding hole of the extruding die.
Figure 6:
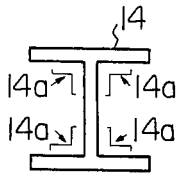
FIG. 6 is a cross-sectional view of the profiled work extruded through the extruding die of FIG. 5.

FIG. 5 shows an example of an extruding die 13 having a rather complicated I-shaped extruding hole 13*a* for extruding a profiled work 14 for use in making window frame having a cross-section as shown in FIG. 6.

When such a profiled work is extruded using the extruding die 13 with the abrasive containing disc 5 of the present invention being interposed between the extruding die 13 and the billet 1 from which the profiled work 14 is to be produced by extruding operation, the surface brilliancy tends to be deteriorated in the areas indicated by reference numerals 14*a* in FIG. 6 as the extruding operation proceeds to the end. Under such conditions, it is observed that the bearing surface portions 13*b* of the extruding hole 13*a* in FIG. 5 corresponding to the areas 14*a* of the profiled work 14 are deteriorated by materials of the billet sticking to the bearing surface portions 13*b*. This is due to the fact that the polishing effect by the abrasive in the disc 5 is insufficient at the bearing surface portions 13*b*. This fact apparently indicates that the abrasive to be supplied from the disc 5 to the bearing surface portions 13*b* has been almost consumed or used up at the earlier stage of the extruding operation so that no polishing effect is obtained at the bearing surface portions 13*b* at the later stage of the extruding operation.

Figure 7:
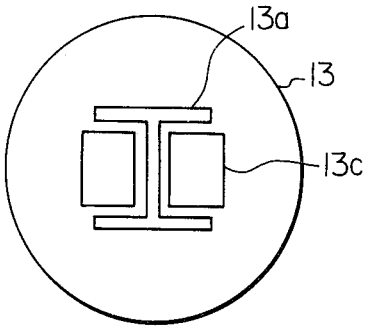
FIG. 7 is a front view showing a modified extruding die of FIG. 5 in which a pair of recesses are formed in the surface of the die for retaining the abrasive containing disc until the end of the extruding operation.

In order to avoid the above described shortcomings, in accordance with another characteristic feature of the present invention, the extruding die 13 is formed with a pair of shallow recesses or pockets 13*c* near the extruding hole 13*a* at the bearing surface portions 13*b* as shown in FIG. 7 thereby permitting the early consumption of the disc 5 at the bearing surface portions 13*b* to be positively avoided during the extruding operation and sufficient polishing effect on the bearing surface portions 13*b* to be maintained until the last stage of the extruding operation.

Figure 10:
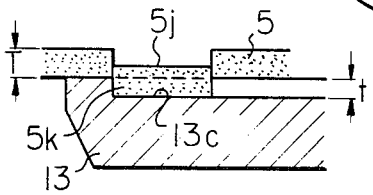
FIG. 10 is a sectional view showing the depth of the recess formed in the die in which the abrasive containing disc is filled at the beginning of the extruding operation.

The above effect is achieved due to the fact that portions of the disc 5 fill the recesses 13*c* at the beginning of the extruding operation as shown in FIG. 10 so that the disc 5 is gradually consumed at the recesses 13*c* during the extruding operation thereby permitting the abrasive in the disc 5 to be supplied until the last stage of the extruding operation so as to maintain polishing effect on the bearing surfaces 13*b* until the end of the extruding operation.

The depth *t* of the recess 13*c* is selected to be less than the thickness T of the disc 5 as shown in FIG. 10. By setting the depth *t* of the recess 13*c* as described above, the portion 5*j* of the disc 5 in the range of the recess 13*c* protruding above the plane of the die 13 is used at the initial stage of the extruding operation while the portion 5*k* of the disc 5 entirely fitting within the recess 13*c* is gradually removed from the recess 13*c* during the later stage of the extruding operation and supplied continuously or intermittently to the bearing surface portions 13*b* of the extruding hole 13*a* of the die 13 until the end of the extruding operation thereby permitting superior brilliancy of the extruded profiled work to be obtained over the entire length thereof.

Figure 8:
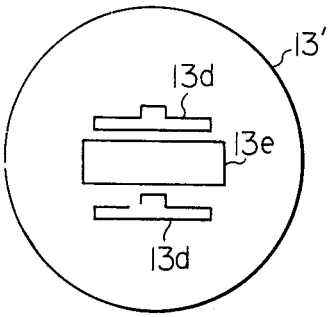
FIGS. 8 and 9 are front views showing alternative embodiments of the recess formed in the extruding die, respectively.
Figure 9:
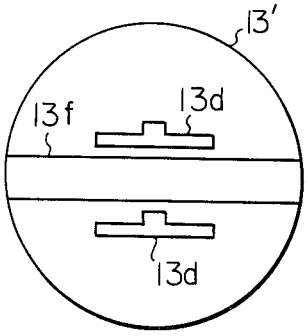

FIGS. 8 and 9 show modifications of the recess formed in the extruding die 13' having two extruding holes 13*d*. The recess 13*e* in FIG. 8 is formed in a limited area between the two extruding holes 13*d*, while the recess 13*f* in FIG. 9 extends entirely of the extruding die 13' between the two extruding holes 13*d*. Both the embodiments can well effect the same performance for mantaining the polishing effect on both the bearing surfaces of the two extruding holes 13*d* until the end of the extruding operation.

The recess formed in the surface of the extruding die may be divided into a plurality of recesses depending upon the condition of the extruding process.

Now, several examples of experiments according to the method of the present invention will be described below in comparison with the experiments carried out by the conventional method.

EXAMPLE 1

(1) A billet 9f 6063 aluminum alloy (Si 0.45%, Mg 0.66%, balance Al and trace of impurities) having a diameter 9f 275mm and a length of 960mm was extruded by using an extruding machine having a capacity of 3500T at a temperature of 480° C. with an abrasive containing disc of aluminum alloy having the same composition as the billet and containing 0.051% by weight of B for forming abrasive particles and having a thickness of 2mm being interposed between the extruding die and the billet in the container of the extruding machine so as to form a profiled work of U-shaped cross-section (extrusion ratio 83).

(2) For comparison purpose, an extruding process was carried out under the same conditions as described above but without using the disc.

In the case (1), the extruding velocity was set to 25m/min. and no pick-up was found in the surface of the extruded profiled work over the entire length thereof, while the surface quality was kept superior.

In the case (2), however, pick-up was already generated in the surface of the product even at the extruding velocity of 18 m/min., so that the product was non-usable.

EXAMPLE 2

(1) A billet of 6063 aluminum alloy (the same composition as in Example 1) having a diameter of 100mm and a length of 200mm was extruded by using an extruding machine having a capacity of 600T at a temperature of 480° C. with an abrasive containing disc of the same composition as the billet and further containing 0.1% by weight of B and 0.01% by weight of Ti as the abrasive forming elements and having the thickness of 2mm being interposed between the extruding die and the billet so as to form a flat plate (extrusion ratio 40).

(2) For the comparison purpose, the extruding process was carried out under the same conditions but without using the disc.

In the case (1), no pick-up occurred even though the extruding velocity was raised to 50 m/min.

In the case (2), however, the extruding velocity was limited to 30 m/min. in order to obtain a product having no surface defects.

Further, the product in the case (1) was subjected to coloring anodic oxidation treatment of the conventional (Asada) method for coloring the product in beige color, and no local colorless spots occurred in the treated surface of the product and uniformly colored film was obtained in the surface of the product.

EXAMPLE 3

The extruding process was carried out under the same conditions as in Example 2, but the extrusion ratio was set to 65.

As to the element to be included in the abrasive containing disc, the elements and the contents thereof given in the following table 1 were used. The effectiveness of each abrasive containing disc of table 1 is also given in the table 1.

Table 1

| Element contained in Disc | Content of Element 6% by Wt.) | Reflecting Power of Surface (%) | Pick-up |
|---|---|---|---|
| B | 0.003 | 26 | Reduced |
| | 0.005 | 40 | " |
| | 0.010 | 47 | No pick-up |
| | 0.070 | 52 | " |
| | 0.100 | 53 | " |
| | 0.500 | 53 | " |
| Be | 0.03 | 24 | Tends to reduce |
| | 0.05 | 27 | No pick-up |
| | 0.20 | 45 | " |
| | 0.50 | 48 | " |
| Ti | 0.05 | 33 | Reduced |
| | 0.10 | 36 | " |
| Zr | 0.03 | 34 | Reduced |
| | 0.15 | 35 | " |
| | 1.00 | 37 | " |
| W | 0.05 | 35 | Reduced |
| | 0.50 | 36 | " |
| | 1.00 | 30 | " |
| Mo | 0.05 | 23 | Reduced |
| | 0.50 | 23 | " |
| | 1.00 | 30 | " |
| V | 0.05 | 23 | Reduced |
| | 0.50 | 25 | " |
| | 1.00 | 25 | " |

EXAMPLE 4

A billet of 6063 aluminum alloy (the same composition as in Example 1) and having a diameter of 11" and a length of 960mm was extruded by using an extruding machine having a capacity of 3600T at a temperature of 480° C. so as to form a profiled work of U-shaped cross-section in like manner as in the case of Example 1 for producing a front decoration panel of sterotuner.

The abrasive containing disc used in the extruding process had a thickness of 1mm and was made of pure aluminum containing therein the element B as the abrasive forming element, the content of which was variously selected as shown in the following table 2. The upper limit of the extruding velocity obtained by using the respective abrasive containing disc having various content of B shown in the table 2 is also shown in the table 2.

Table 2

| Content of B (% by wt.) | Upper Limit of Extruding Velocity (m/min.) |
|---|---|
| — | 14 |
| 0.003 | 19 |
| 0.005 | 28 |
| 0.010 | 30 |
| 0.070 | more than 30* |
| 0.100 | more than 30* |
| 0.500 | more than 30* |

*When the content of B exceeds 0.070%, the shape of the extruded profiled work was deteriorated by the non-uniform heat generation at portions of the profiled work due to two high extruding velocity, but it has no relationship to the effectiveness of the abrasive containing disc per se. Therefore, the extruding velocity is preferably limited to 30 m/min. in case the content of B exceeds 0.07%.

We claim:

1. In a method of making a profiled work of aluminum or aluminum alloy by an extruding process including the steps of loading a billet of aluminum or aluminum alloy into a container having an extruding die formed with at least one extruding hole of required configuration mouned at one end thereof, and moving a ram into said container from the opposite end thereof so as to urge said billet against said extruding die thereby permitting said billet to be extruded through said extruding hole so as to form a profiled work having its cross-section conforming with the configuration of said extruding hole, the improvement comprising locating a preformed abrasive containing disc of aluminum or aluminum alloy between said extruding die and said billet prior to extruding said billet through said extruding hole said disc containing at least one element selected from the group consisting of elements B, Be, Ti, Zr, W, Mo and V, said element forming very hard and fine particles acting as the abrasive.

2. The method according to claim 1, wherein the thickness of said abrasive containing disc is selected to be in the range of 0.1 and 10mm, and at least two separate peripheral portions of the periphery of said disc extend beyond the inner diameter of said container so as to maintain said disc in position with respect to said billet when the same is loaded in said container.

3. The method according to claim 1, wherein said abrasive containing disc is preliminarily attached to the front end of said billet facing to said extruding die prior to loading of said billet into said container.

4. The method according to claim 3, wherein said disc is secured to the front end of said billet by riveting.

5. The method according to claim 3, wherein said disc is secured to the front end of said billet by welding.

6. Method according to claim 1, wherein said abrasive containing disc is fed to the open end of said container by means of a feeding machine before said billet is loaded into said container so as to be moved together with said billet toward said extruding die when said billet is loaded into said container.

7. The method according to claim 1, wherein the content of B in said disc ranges between 0.003 and 0.50% by weight.

8. The method according to claim 1, wherein the content of Be in said disc ranges between 0.03 and 0.50% by weight.

9. The method according to claim 1, wherein the content of Ti in said disc ranges between 0.05 and 0.10% by weight.

10. The method according to claim 1, wherein the content of Zr in said disc ranges between 0.03 and 1.00% by weight.

11. The method according to claim 1, wherein the content of W in said disc ranges between 0.05 and 1.00% by weight.

12. The method according to claim 1, wherein the content of Mo in said disc ranges between 0.05 and 1.00% by weight.

13. The method according to claim 1, wherein the content of V in said disc ranges between 0.05 and 1.00% by weight.

14. The method according to claim 1, wherein the surface of said extruding die contacting with said abrasive containing disc is formed with at least a shallow recess near the bearing surface of said extruding hole of said extruding die so as to prevent excessive initial flow of said disc through said extruding hole at the early stage of the extruding operation.

15. The method according to claim 14, wherein the depth of said shallow recess is selected to be smaller than the thickness of said abrasive containing disc.

16. The method according to claim 14, wherein said shallow recess is divided into a plurality of recessed portions.

* * * * *